United States Patent [19]

Nakamura

[11] Patent Number: 4,522,032

[45] Date of Patent: Jun. 11, 1985

[54] STIRLING-CYCLE REFRIGERATOR

[75] Inventor: Kazuaki Nakamura, Kariya, Japan

[73] Assignee: Aisin Seiki Kabushiki Kaisha, Kariya, Japan

[21] Appl. No.: 527,223

[22] Filed: Aug. 29, 1983

[30] Foreign Application Priority Data

Sep. 24, 1982 [JP] Japan ..... 57-164847

[51] Int. Cl.[3] ..... F25B 9/00

[52] U.S. Cl. ..... 62/6; 62/513

[58] Field of Search ..... 62/6, 113, 513

[56] References Cited

U.S. PATENT DOCUMENTS

| | | | |
|---|---|---|---|
| 2,480,525 | 8/1949 | Van Weenen | 62/6 |
| 2,657,553 | 11/1953 | Jonkers | 62/6 |
| 3,310,954 | 3/1967 | Sijtstra et al. | 62/6 |
| 3,355,882 | 12/1967 | Kohler et al. | 62/6 |
| 3,365,896 | 1/1968 | Berry | 62/6 |
| 3,372,554 | 3/1968 | Prast et al. | 62/6 |
| 3,383,872 | 5/1968 | Kohler | 62/6 |
| 3,400,544 | 9/1968 | Prast | 62/6 |
| 3,487,424 | 12/1969 | Leger | 62/6 |

*Primary Examiner*—Ronald C. Capossela

*Attorney, Agent, or Firm*—Burns, Doane, Swecker & Mathis

[57] ABSTRACT

A Stirling-cycle refrigerator comprises a plurality of Stirling-cycle refrigerator units each having a displacer defining an expansion chamber, a piston defining a compression chamber, and a circuit including a heater and a cooler and interconnecting the expansion chamber and the compression chamber, and a heat exchanger shared by the circuits and disposed between the coolers and the heaters for effecting heat exchange between working gases in the circuits. The heat exchanger may comprise a countercurrent heat exchanger, and the Stirling-cycle refrigerator units are operated in cycles which are 180° out of phase with each other.

2 Claims, 2 Drawing Figures

STIRLING-CYCLE REFRIGERATOR

BACKGROUND OF THE INVENTION

The present invention relates to a Stirling-cycle refrigerator, and more particularly to a Stirling-cycle refrigerator capable of lowering a refrigerating temperature.

Stirling-cycle refrigerators comprise an expansion chamber defined by a displacer and a compression chamber defined by a piston, the expansion and compression chambers being interconnected through a heater or a high-temperature heat exchanger, a regenerator, and a cooler or a low-temperature heat exchanger. The displacer and the piston are operated out of phase with each other by a crank mechanism or a swash plate cam mechanism to cause a working gas to go through a continuous cycle of isothermal compression, isometric change, isothermal expansion, and isometric change for refrigeration.

The regenerator in the Stirling-cycle refrigerator of the type described contains a material made of metal or the like for storing heat. In general, when the temperature of a metal drops, the specific heat of the metal declines as does the heat storing ability thereof. With conventional regenerators filled with a metallic material, the lowest temperature which the refrigerator can achieve is governed by the specific heat of the metallic material used, and has been in the range of from 8° to 9° K.

SUMMARY OF THE INVENTION

It is an object of the present invention to provide a Stirling-cycle refrigerator capable of lowering its refrigerating temperature down to a range of from 3° to 4° K.

The above object can be achieved by providing means for carrying out heat exchange between working gases in circuits of a plurality of Stirling-cycle refrigerator units, each of the circuits interconnecting a compression chamber and an expansion chamber. With heat exchange between the working gases, the capacity of a regenerator material to store heat at a low temperature can be increased to thereby lower the refrigerating temperature. This makes it unnecessary to employ a conventional regenerator and thus simplifies the construction of the refrigerator.

According to the present invention, a Stirling-cycle refrigerator comprises a plurality of Stirling-cycle refrigerator units each having a displacer defining an expansion chamber, a piston defining a compression chamber, and a circuit including a heater and a cooler and interconnecting the expansion chamber and the compression chamber, and a heat exchanger shared by the circuits and disposed between the coolers and the heaters for effecting heat exchange between working gases in the circuits.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
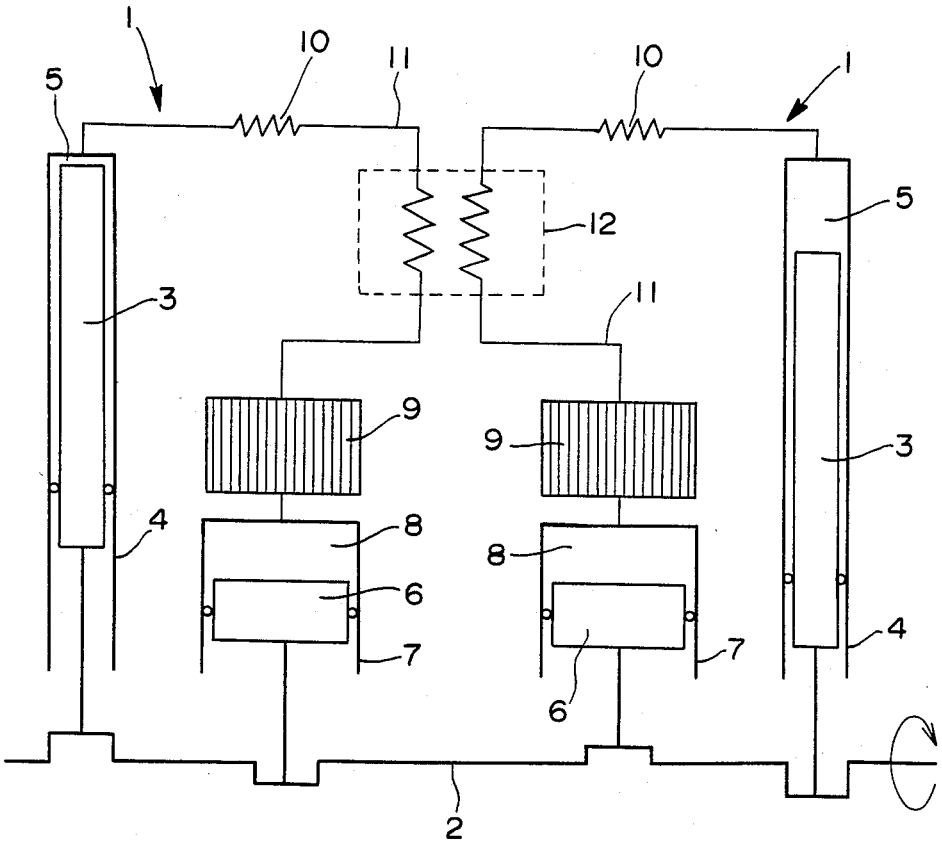
FIG. 1 is a schematic diagram of a Stirling-cycle refrigerator according to an embodiment of the present invention.

As shown in FIG. 1, a Stirling-cycle refrigerator comprises a pair of Stirling-cycle refrigerator units 1, 1 juxtaposed and ganged to operate out of phase. The two Stirling-cycle refrigerator units 1, 1 are of the same construction, and hence only one of them will be described. The Stirling-cycle refrigerator unit 1 has a displacer 3 coupled to a drive mechanism 2 such as a crank shaft and slidably fitted in a cylinder 4 to define an expansion chamber or space 5 therein. A piston 6 is also coupled to the drive mechanism 2 and slidably fitted in a cylinder 7 to define a compression chamber or space 8 therein. The expansion chamber 5 and the compression chamber 8 are interconnected by a circuit 11 having a heater or high-temperature heat exchanger 9 and a cooler or low-temperature heat exchanger 10.

Heat exchange between working gases filled in the respective Stirling-cycle refrigerator units 1, 1 is carried out by a countercurrent heat-exchanger 12 shared by the circuits 11, 11 and disposed between the heaters 9 and the coolers 10. The operating cycles of the Stirling-cycle refrigerator units 1, 1 are 180° out of phase with each other for efficient heat exchange between the working gases in the two Stirling-cycle systems.

Figure 2:
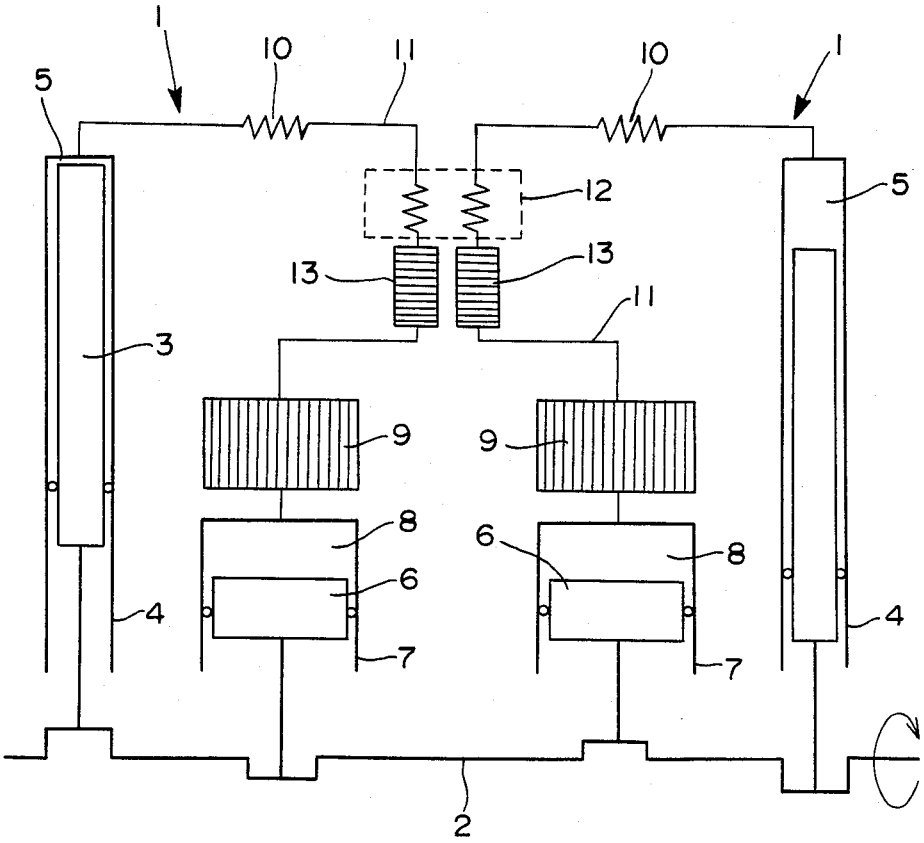
FIG. 2 is a schematic diagram of a Stirling-cycle refrigerator according to another embodiment of the present invention.

FIG. 2 shows a Stirling-cycle refrigerator constructed according to another embodiment of the present invention. This Stirling-cycle refrigerator has the same basic arrangement as that of the refrigerator shown in FIG. 1, but includes an additional pair of regenerators 13, 13 of a known construction connected in the circuits 11, 11 in series with the countercurrent heat-exchanger 12. The additional regenerators 13, 13 serve to reduce the burden on the countercurrent heat-exchanger 12 for an increased rate of heat exchange.

Although certain preferred embodiments have been shown and described, it should be understood that many changes and modifications may be made therein without departing from the scope of the appended claims.

What is claimed is:

1. A Stirling-cycle refrigerator comprising:

(a) a plurality of Stirling-cycle refrigerator units, each having:
  (1) a displacer defining an expansion chamber;
  (2) a piston defining a compression chamber; and
  (3) a circuit including a heater and a cooler and interconnecting said expansion chamber and said compression chamber;

(b) a countercurrent heat exchanger shared by said circuits and disposed between said coolers and said heaters for effecting heat exchange between working gases in said circuits; and (c) a pair of regenerators connected in said circuits, respectively, in series with said countercurrent heat exchanger.

2. A Stirling-cycle refrigerator mechanism according to claim 1, further comprising a drive mechanism coupled to said displacer and said piston for operating said Stirling-cycle refrigerator units in cycles which are out of phase with each other.

* * * * *